United States Patent [19]

Kageyama et al.

[11] 3,942,066

[45] Mar. 2, 1976

[54] VELOCITY MODULATION TUBE INCLUDING A HIGH RESONANCE-FREQUENCY FLOATING PREBUNCHER HAVING A Q-VALUE LOWER THAN A LOW RESONANCE-FREQUENCY INPUT CAVITY

[75] Inventors: Takao Kageyama; Yosihiro Morizumi, both of Tokyo, Japan

[73] Assignee: Nippon Electric Company Limited, Tokyo, Japan

[22] Filed: Feb. 24, 1975

[21] Appl. No.: 552,436

Related U.S. Application Data

[63] Continuation-in-part of Ser. No. 408,186, Oct. 19, 1973, abandoned.

[30] Foreign Application Priority Data

Oct. 25, 1972 Japan ..... 47-106800

[52] U.S. Cl. ..... 315/5.43; 315/5.46

[51] Int. Cl.[2] ..... H01J 25/10

[58] Field of Search ..... 332/7; 315/5.39, 5.43, 315/5.46

[56] References Cited

UNITED STATES PATENTS

| | | | |
|---|---|---|---|
| 3,622,834 | 11/1971 | Lien | 315/5.39 |
| 3,725,721 | 4/1973 | Levin | 315/5.43 |

*Primary Examiner*—John Kominski

*Attorney, Agent, or Firm*—Ostrolenk, Faber, Gerb & Soffen

[57] ABSTRACT

In a velocity modulation tube comprising a floating prebuncher and at least one final prebuncher, frequencies of respective fundamental modes of resonance of the input cavity, the floating prebuncher, and the final buncher are adjusted to the lowest frequency of the passband of the tube, adjacent to the highest frequency of the passband, and higher than the highest frequency, respectively. Furthermore, the Q-value of the floating prebuncher is made equal to or lower than that of the input cavity. Naturally, the output cavity has its fundamental mode of resonance approximately at the center of the passband.

9 Claims, 7 Drawing Figures

FIG. 1
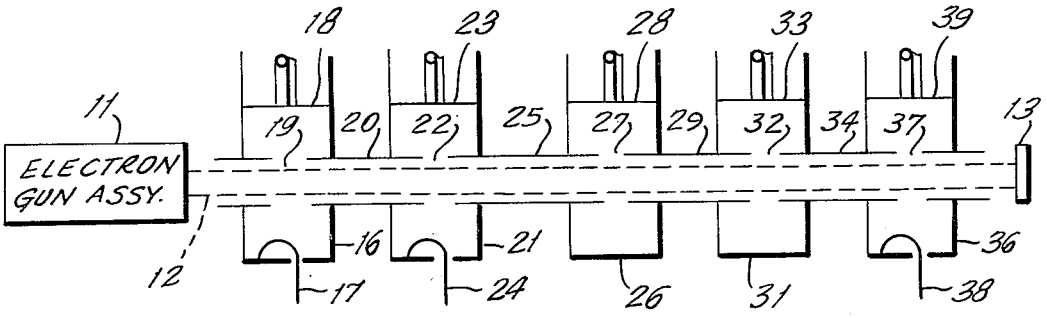
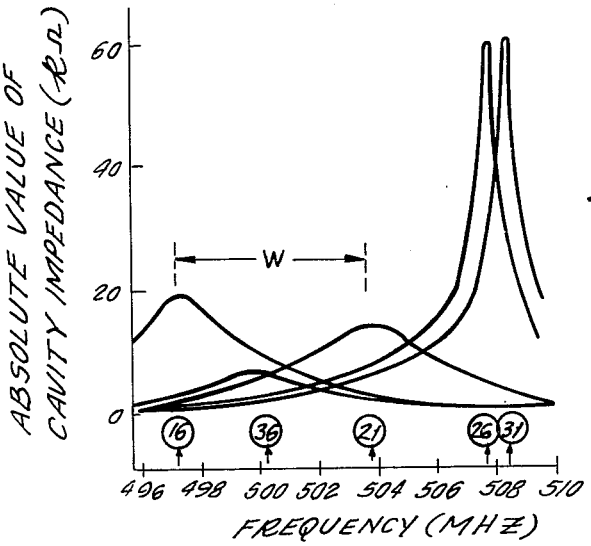
FIG. 3
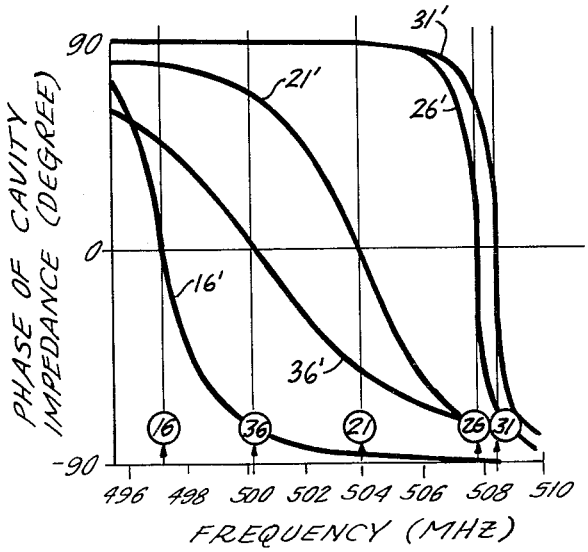
FIG. 4

FIG. 2
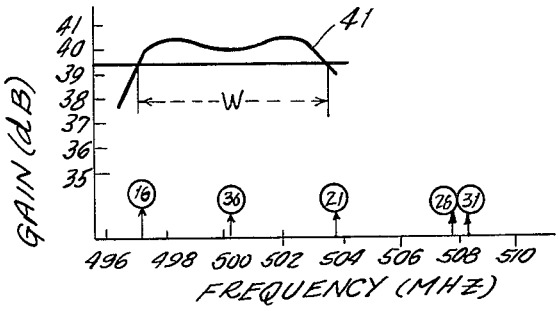
FIG. 5
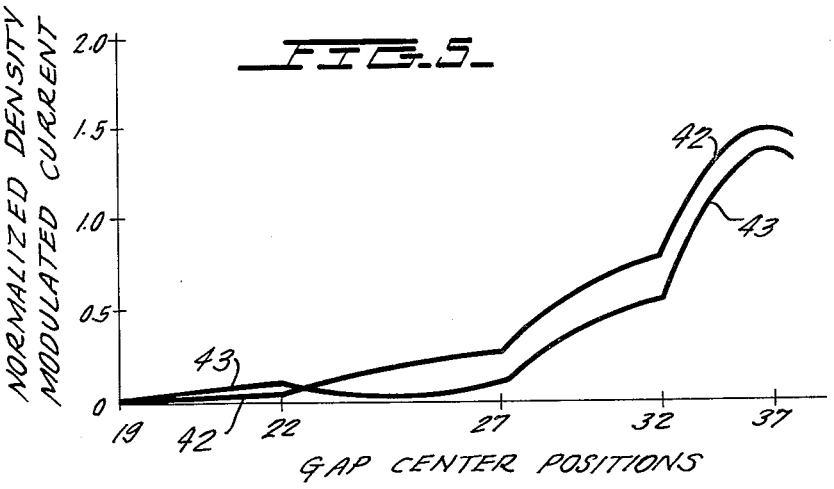
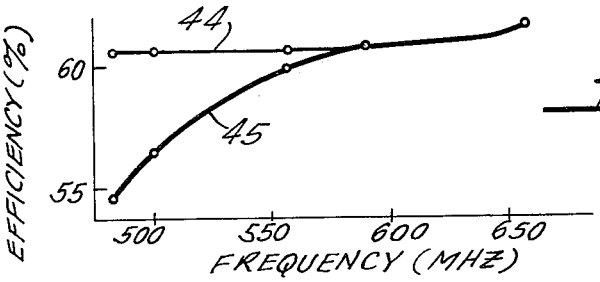
FIG. 6
FIG. 7
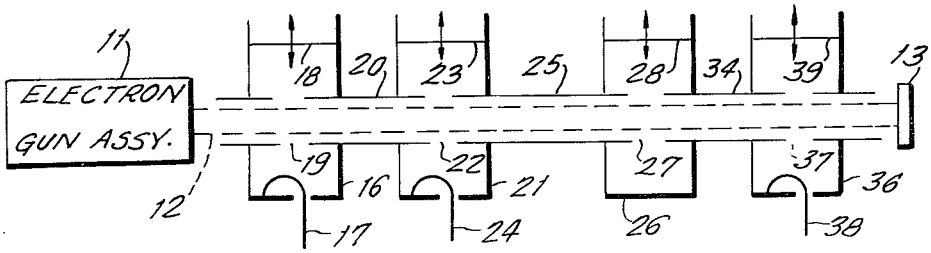

VELOCITY MODULATION TUBE INCLUDING A HIGH RESONANCE-FREQUENCY FLOATING PREBUNCHER HAVING A Q-VALUE LOWER THAN A LOW RESONANCE-FREQUENCY INPUT CAVITY

CROSS-REFERENCE TO RELATED APPLICATION

This is a continuation-in-part application of our copending patent application Ser. No. 408,186 filed Oct. 19, 1973, now abandoned claiming the Convention Priority based on a patent application No. 106,800/72 filed Oct. 25, 1972, in Japan.

BACKGROUND OF THE INVENTION

This invention relates to a velocity modulation tube comprising a plurality of intermediate or floating resonators and short drift spaces. The floating resonator of a velocity modulation tube is defined as a resonator which is placed intermediate the input and the output resonators and which has neither a source of energy external to the tube nor a load external to the tube for utilizing the output power of the resonator. This, however, does not preclude a circuit element coupled to the resonator solely for effecting certain characteristics of the resonator.

In connection with a velocity modulation tube, it should be noted here that the interaction gap associated with a resonator contributes to the interaction between the electron beam produced in the tube and the electromagnetic field induced in the resonator and that the drift space interposed between two adjacent interaction gaps contributes to bunching of the velocity modulated electron beam. The length of a drift space is generally expressed by the normalized length in terms of the reduced plasma angle given by $\omega_q 1/u_o$, where $\omega_q$ represents the reduced plasma angular velocity, $u_o$ represents the D.C. beam speed, and 1 represents the physical distance between the middle points of the interaction gaps placed at both ends of the drift space. For brevity, the phrase "in terms of the reduced plasma angle" will be omitted in the following where possible. In addition, a drift space located immediately downstream of the interaction gap associated with a resonator will merely be referred to as a drift space located or placed immediately downstream of the resonator where intelligible. The words "upstream" and "downstream" refer to the macroscopic flow of the electron beam.

In a multi-cavity velocity modulation tube, it is usual to select various frequencies for the fundamental modes of resonance of the resonators in order to improve the gain-to-frequency characteristics of the tube. Thus, it has been conventional to tune the input resonator to the center frequency of the operating passband of the tube or to a somewhat higher frequency and to tune a floating prebuncher placed immediately downstream of the input resonator to a frequency lower than the center frequency. Consequently, the voltage induced across the gap of the floating prebuncher in the adjacency of the center frequency is nearly in phase opposition to the voltage produced across the gap of the input resonator to debunch the once bunched electron beam. If the drift space placed immediately downstream of the floating prebuncher is shorter than 60°, there is no room for the debunched electron beam to again become bunched. This prevents the electrons from being desirably bunched at the gap of the output resonator to result in a defect of limited conversion efficiency of the tube.

In order to raise the conversion efficiency of velocity modulation tubes, it has been proposed by Erling L. Lien in his U.S. Pat. No. 3,622,834 to use between a floating prebuncher and a final prebuncher placed next downstream of the floating prebuncher a lengthy drift space whose normalized length is between 90° and 150°, preferably 120°. The tube, however, is difficult to handle due to its abnormal length and renders a UHF television transmitter bulky. In addition, the operable or tunable frequency range of the tube is narrow and restricted because use is made of the second harmonic space charge force and because the long drift sapce must be about 120° long at the operating frequency.

On the other hand, a velocity modulation tube comprising drift spaces whose normalized lengths are only 90° or less is revealed in U.S. Pat. No. 3,819,977 issued to Takao Kageyama, one of the present joint applicants, wherein the drift space disposed immediately downstream of the floating prebuncher is made longer than other drift spaces but not longer than 90°. This tube is advantageous in that the operable frequency range or band is relatively wide because no use is made of the second harmonic space charge force. It is, however, to be noted that the reduced plasma angle becomes long to make the normalized drift length of the drift space in question shorter than 60° in case a tube designed for higher frequency channels of, for example, a UHF television transmitter, is used for lower frequency channels with the resonance frequencies of the resonators merely reduced. This makes it impossible for the debunched electron beam to be bunched anew in the drift space and reduces the conversion efficiency.

In U.S. Pat. No. 3,725,721 issued to Martin E. Levin, a velocity modulation tube of a wide operable or tunable frequency band is disclosed, wherein a floating prebuncher and a final prebuncher placed next downstream of the floating prebuncher are tuned to the low and high frequency ends of the operating passband of the tube, respectively, as in a prior art velocity modulation tube. According to this patent, at least each of these prebunchers is provided with a series resonant circuit whose series resonant frequency is set at a frequency lower than the tunable band so as to automatically increase the Q-value of the relevant prebuncher to an optimum value with an increase in the frequency within the tunable band. This precludes the necessity of separate adjustment of the Q-values of these prebunchers but necessitates a somewhat complicated structure of such a prebuncher.

SUMMARY OF THE INVENTION

It is therefore an object of the present invention to provide a multi-cavity velocity modulation tube having excellent conversion efficiency.

It is another object of this invention to provide a velocity modulation tube of the type described, which is operable over a wide range of operable or tunable frequencies.

It is still another object of this invention to provide a velocity modulation tube of the type described, wherein none of its resonator circuits are loaded by specific series resonant loading circuits.

In the manner known in the art, a multi-cavity velocity modulation tube operable in a predetermined operating passband of frequencies according to this invention comprises, in a vacuum envelope and successively in mutually spaced relation, electron gun means for emitting an electron beam, an input resonator circuit having means for coupling thereto a source of energy external to the vacuum envelope, a first and a second floating resonator circuit, an output resonator circuit having means for coupling thereto a load external to the vacuum envelope, and a collector electrode for the electron beam. Each of the input, first and second floating, and output resonator circuits has interaction gap means operatively associated with the electron beam for providing interaction between the electron beam and electromagnetic field induced in the associated resonator circuit. The tube further comprises a plurality of drift spaces for the electron beam, extending from the interaction gap means of the input resonator circuit backwardly of the electron beam towards the electon gun means, extending between the interaction gap means of the input, first and second floating, and output resonator circuits, and extending from the interaction gap means of the output resonator circuit forwardly of the electron beam towards the collector electrode. The second floating and the output resonator circuits have fundamental modes of resonance at a frequency higher than the highest frequency of the passband and at an approximate center of the passband, respectively. The second floating resonator circuit has a Q-value greater than the input resonator circuit. In accordance with this invention, the input and the first floating resonator circuits are possessed of fundamental modes of resonance at frequencies adjacent to the lowest and the highest frequencies of the passband, respectively. Furthermore, the first floating resonator circuit is provided with a Q-value which is equal to or smaller than the Q-value of the input resonator circuit.

In accordance with the gist of this invention set forth hereinabove in the last paragraph, it should be understood that a velocity modulation tube according to this invention may have an additional second floating resonator circuit placed next downstream of the first-mentioned second floating resonator circuit. The additional resonator circuit is referred to as one of the second floating resonator circuit means because it also has interaction gap means operatively associated with the electron beam and electromagnetic field induced in the additional resonator circuit, with another drift space for the electron beam being disposed between the first-mentioned and the additional second floating resonator circuits, and because it has its fundamental mode of resonance at a frequency higher than the operating passband and a Q-value greater than the input resonator circuit.

In marked contrast to conventional tuning schemes for multicavity velocity modulation tubes wherein the input resonator circuit is provided with a fundamental mode of resonance within the operating passband of the tube, the fundamental mode of resonance of the input resonator circuit is preferably placed according to this invention a little below the lowest frequency end of the operating passband while the fundamental mode of resonance of the first floating resonator circuit is placed a little above the highest frequency end of the passband.

BRIEF DESCRIPTION OF THE DRAWING:

FIG. 1 is a schematic longitudinal sectional view of a multi-cavity velocity modulation tube according to a first embodiment of the present invention;

FIG. 2 shows the gain of the tube illustrated in FIG. 1 versus operating frequencies and the frequencies at which the cavities of the tube have the fundamental modes of resonance;

FIG. 3 shows the impedance of each cavity seen from their respective interaction gaps as a function of frequency;

FIG. 4 shows the phases of the respective cavity impedances;

FIG. 5 shows the normalized density modulated fundamental mode beam current components of the tube illustrated in FIG. 1 and of a conventional tube versus the distance along the beam axis;

FIG. 6 shows curves representing the conversion efficiencies of the tube depicted in FIG. 1 and a conventional tube; and FIG. 7 is a schematic longitudinal sectional view of a velocity modulation tube according to a second embodiment of this invention.

DESCRIPTION OF THE PREFERRED EMBODIMENTS

Referring to FIG. 1, a velocity modulation tube according to a first embodiment of the instant invention comprises an electron gun assembly 11 adjacent to one end of a bulb or vacuum envelope (not shown for purposes of simplicity) known in the art for producing an electron beam 12 and a collector electrode 13 for the electron beam 12 adjacent to the other end of the bulb. An input resonator circuit 16 of the reentrant type is situated adjacent to the upstream end of the electron beam 12, which resonator circuit may be excited by high-frequency electromagnetic energy through an input coupling loop 17. The high-frequency energy is derived from an energy source (not shown for purposes of simplicity) known in the art and placed external to the bulb. The input cavity 16 has a fundamental mode of resonance adjacent to the lowest frequency end of the operating passband of the tube. The input cavity 16 is preferably tuned to a frequency a little lower than the lowest frequency end and may be adjustably tuned by the adjustment of resonance frequency adjusting means, such as a tuning short 18. The input cavity 16 comprises an interaction gap 19 defined between the adjacent free ends of the reentrant cavity. The high-frequency voltage induced across the gap 19 interacts with the electron beam 12 to velocity modulate the beam 12. A first drift tube 20 is disposed around the electron beam 12 in the downstream region of the input cavity 16 to provide a first drift space free of the high-frequency electromagnetic field, in which the electron beam 12 is drifted with a velocity determined by the velocity modulation imposed thereon at the input cavity gap 19 to be bunched. A prebuncher resonance circuit 21 having an interaction gap 22 at the downstream end of the first drift space has its fundamental mode of resonance adjacent to the highest frequency end of the passband. The prebuncher 21 is preferably tuned to a frequency somewhat higher than the highest frequency end and may be equipped with a tuning short 23 and with coupling means, such as a loop 24, for connection to a simple resistor or the like (not shown) disposed external to the bulb for adjusting the Q-value of the prebuncher 21. In the manner known in the art, the electron beam 12 passing by the prebuncher gap 22 is given a fundamental mode density modulated current component whose phase lags about 90° behind the voltage induced across the input resonator gap 19. As a result, the density modulated electron beam excites the prebuncher 21 at its gap 22 to induct an electric current along the inside wall thereof approximately in phase with the fundamental mode density modulated current component. On the other hand, the impedance of the prebuncher 21 as seen from its gap 22 in the vicinity of the center frequency of the passband is inductive as will be discussed later. Consequently, the induced current in turn induces a voltage across the prebuncher gap 22 whose phase advances the induced current. It is now understood that the velocity modulation imposed on the electron beam 12 at the prebuncher gap 22 tends to strengthen that bunching of electrons which occurred in the first drift tube 20. The electron beam 12 is therefore further bunched in a second drift tube 25 disposed immediately downstream of the prebuncher 21.

Referring further to FIG. 1, a first final buncher 26 comprises an interaction gap 27 and has a fundamental mode of resonance at a frequency appreciably higher than the highest frequency of the passband. Tuning of the final buncher 26 may be adjusted by a tuning short 28. The impedance of the final buncher 26 as seen from its gap 27 in the neighborhood of the center frequency of the passband is therefore sufficiently inductive to render the voltage induced across the gap 27 by the electron beam 12 substantially in phase with the voltages induced across the input cavity gap 19 and the prebuncher gap 22. The velocity modulation effected by the first final buncher gap 27 on the electron beam 12 is thus in the direction of further strengthening the bunching already given thereto. The electron beam 12 is now further bunched in a third drift tube 29 located next downstream of the first final buncher 26. A second final buncher 31 having an interaction gap 32 has its fundamental mode of resonance at a frequency approximately equal to that at which the first final buncher 26 has its fundamental mode of resonance. The second final puncher 31 may also have a tuning short 33. Like the first final buncher 26, the second final buncher 31 still further strengthens the bunching in a fourth drift tube 34 connected to this buncher 31. An output resonance circuit 36 having an interaction gap 37 and an output coupling loop 38 may be adjustably tuned by a tuning short 39 to a frequency near the center of the passband. The output coupling loop 38 may be connected to a load (not shown for the purpose of simplicity) located external to the bulb for utilizing the amplified high-frequency energy in the manner known in the art.

It has now been confirmed that the cavity impedance of the respective cavity resonators used in a multicavity velocity modulation tube have effects on the conversion efficiency and gain-to-frequency characteristics of the tube. The relation between the Q-value of each of the cavity resonators and the absolute value $|Z|$ of the cavity impedance as seen from its interaction gap is given by:

$$|Z| = R\sqrt{1 + Q^2(f_1/f_0 - f_0/f_1)^2}. \quad (1)$$

where $f_0$ and $f_1$ represent the resonance frequencies of the resonator and the operating frequency of the tube and $R$ represents the total parallel loss resistance of the resonator. On the other hand, the relation between the Q-value and the phase $\theta$ of the cavity impedance is given by:

$$\theta = \arctan Q(f_0/f_1 - f_1/f_0). \quad (2)$$

Referring to FIG. 2, curve 41 represents the gain-to-frequency characteristics of a velocity modulation tube according to the first embodiment. The center frequency of its operating passband is 500 MHz. The passband width W between points 1 dB below the maximum gain is about 7 MHz. The fundamental modes of resonance of the cavity resonators 16, 21, 26, 31, and 36 are placed at frequencies indicated by like reference numerals encircled. The input resonator 16 has a Q-value of 195 due to the input coupling loop 17. The Q-value of the floating prebuncher 21 is reduced to 140 by connecting a resistor (not shown) of 50 ohms to the loop 24. Each of the final floating bunchers 26 and 31 has a Q-value of 650. It will be seen that these bunchers 26 and 31 are unloaded. The output resonator circuit 36 has a Q-value of 55 due to the output coupling loop 38 and the load (not shown) connected thereto.

Referring to FIG. 3, the absolute values of the respective cavity impedances as calculated with the use of Equation (1) are plotted versus the frequency. From this figure, it is seen that the final floating bunchers 26 and 31 have large impedance at the highest frequency range of the passband W and that the Q-values of the floating prebuncher 21 should be equal to or smaller than that of the input resonator circuit in order to render the gain-to-frequency characteristic curve 41 shown in FIG. 2 flat.

Referring to FIG. 4, the phases of the respective cavity impedances of the cavity resonators 16, 21, 26, 31, and 36 calculated by the use of Equation (2) vary with the frequency as depicted by curves 16′, 21′, 26′, 31′, and 36′, respectively. From this figure, it is seen that selection of the resonance frequencies of the cavity resonators in the manner taught by this invention makes the impedances of the floating prebuncher 21 and the final floating bunchers 26 and 31 seen from their respective interaction gaps 22, 27, and 37 have advanced phases within the passband to prevent debunching from occuring while the electron beam 12 travels throughout the length of the beam path.

Referring to FIG. 5, curve 42 shows the amplitude of the fundamental mode density modulated current component in the electron beam 12 of a velocity modulation tube according to the first embodiment versus the distance measured along the beam path from the center of the input resonator gap 19. The positions of the gap centers of the other resonator circuits 21, 26, 31, and 36 are shown along the abscissa by reference numerals designating the interaction gaps. The ordinate is normalized by the d.c. beam current. Another curve 43 shows the like amplitude for a conventional velocity modulation tube having a similar structure and the same total length wherein the second harmonic space charge force is not resorted to. From this figure, it is clear that the debunching seen in the curve 43 between the gap centers designated by reference numerals 22 and 27 even at the center frequency of the passband is precluded from the curve 42 and that a stronger density modulated current is obtained at the output resonator gap 37.

Referring to FIG. 6, a curve 44 shows the conversion efficiency of a velocity modulation tube designed according to the first embodiment for an operable or tunable frequency range between 470 and 660 MHz, namely, of the UHF television band. Another curve 45 shows the conversion efficiency of a similar velocity modulation tube of a conventional design. From this figure, it is appreciated that the present invention increases the conversion efficiency at 473 MHz by 5.5 percent and insures a conversion efficiency of about 60 percent throughout the operable band.

Referring finally to FIG. 7, a velocity modulation tube according to a second embodiment of this invention is substantially the same as a velocity modulation tube according to the first embodiment except that use is made of only one final floating buncher 26.

It is to be pointed out here that use may be made of three or more final floating bunchers, such as 26 and 31, insofar as the requirements are for a wide operating passband, wide operable frequency range, and high conversion efficiency. This, however, is objectionable when a velocity modulation tube having the shortest possible length is desired. The second drift tube 25 extending between the floating prebuncher gap 22 and the first final buncher gap 27 may become shorter than 60°, for example, to 45°, in a velocity modulation tube according to this invention. The fundamental modes of resonance of the input resonator circuit 16 and the floating prebuncher 21 should not be spaced outwardly from the passband edges defined above in connection with the passband width W with reference to FIG. 2 more than 15 percent of the passband width W. The fundamental mode of resonance of the final floating buncher 26 or, if any, 31 or the like should be spaced between 50 and 200 percent of the passband width W from the highest frequency end of the passband. Citing another example, a velocity modulation tube designed in accordance with this invention for over-the-horizon microwave transmission has an operating passband width W of about 12 MHz and produces an output power of 10 kW with a conversion efficiency of from 55 to 60 percent throughout an operable frequency range between 2.0 and 2.4 GHz.

It is to be noted here that this invention is not restricted to the embodiments thus far described. For example, distributed interaction gap means composed of a plurality of intercoupled cavity resonators may be used instead of concentrated interaction gap means, such as a reentrant cavity having a single interaction gap.

What is claimed is:

1. In a velocity modulation tube operable in a predetermined operating passband of frequencies, comprising in a vacuum envelope and successively in mutually spaced relation electron gun means for emitting an electron beam, an input resonator circuit having means for coupling thereto a source of energy external to said vacuum envelope, a first and a second floating resonator circuit, an output resonator circuit having means for coupling thereto a load external to said vacuum envelope, and a collector electrode for said electron beam, each of said input, first and second floating, and output resonator circuits having interaction gap means operatively associated with said electron beam for providing interaction between said electron beam and an electromagnetic field induced in the associated resonator circuit, said tube further comprising a plurality of drift spaces for said electron beam extending from the interaction gap means of said input resonator circuit backwardly of said electron beam towards said electron gun means, extending between said interaction gap means of said input, first and second floating, and output resonator circuits, and extending from the interaction gap means of said output resonator circuit forwardly of said electron beam towards said collector electrode, said second floating and output resonator circuits having fundamental modes of resonance at a frequency higher than the highest frequency of said passband and at an approximate center of said passband, said second floating resonator circuit having a Q-value greater than said input resonator circuit, the improvement wherein said input and said first floating resonator circuits have fundamental modes of resonance at frequencies adjacent to the lowest and the highest frequencies of said passband, respectively, and said first floating resonator circuit has a Q-value which is at most equal to the Q-value of said input resonator circuit.

2. A velocity modulation tube as claimed in claim 1, wherein said input and said first floating resonator circuits have fundamental modes of resonance at frequencies outside of said passband.

3. A velocity modulation tube as claimed in claim 1, said passband being between highest and lowest frequency ends at which the gain of the tube is 1 dB below the maximum gain of the tube, wherein said input resonator circuit has its fundamental mode of resonance between said lowest frequency end and a frequency spaced therefrom 15 percent of the band width of said passband and said first floating resonator circuit has its fundamental mode of resonance between said highest frequency end and a frequency spaced therefrom 15 percent of said passband width.

4. A velocity modulation tube as claimed in claim 3, wherein said second floating resonator circuit has its fundamental mode of resonance in a frequency range spaced between 50 and 200 percent of said passband width from said highest frequency end.

5. A velocity modulation tube as claimed in claim 3, wherein the Q-value of said first floating resonator circuit is smaller than the Q-value of said input resonator circuit.

6. A velocity modulation tube as claimed in claim 5, wherein said first floating resonator circuit comprises means for adjusting its Q-value.

7. A velocity modulation tube as claimed in claim 6, wherein said second floating resonator circuit is unloaded.

8. A velocity modulation tube as claimed in claim 7, wherein said input, first and second floating, and output resonator circuits comprise means for adjusting the respective frequencies of the fundamental modes of resonance.

9. A velocity modulation tube as claimed in claim 3, further comprising an additional second floating resonator circuit between the first-mentioned second floating resonator circuit and said output resonator circuit, said additional second floating resonator circuit having interaction gap means operatively associated with said electron beam for providing interaction between said electron beam and an electromagnetic field induced in said additional floating resonator circuit, said tube further comprising a drift space for said electron beam between said additional second floating resonator circuit and said output resonator circuit, wherein said additional second floating resonator circuit has a fundamental mode of resonance in a frequency range spaced between 50 and 200 percent of said passband width from said highest frequency end.

* * * * *